US005692682A

United States Patent [19]

Soule et al.

[11] Patent Number: 5,692,682

[45] Date of Patent: *Dec. 2, 1997

[54] FLAT FAN SPRAY NOZZLE

[75] Inventors: Lincoln S. Soule; James P. Slavas, both of Wendell; Matthew P. Betsold, Northfield; Douglas J. Dziadzio, Montague; Robert E. Bedaw, Sr., Turners Falls, all of Mass.; Vernon L. Bernard, Winchester, N.H.

[73] Assignee: Bete Fog Nozzle, Inc., Greenfield, Mass.

[ * ] Notice: The term of this patent shall not extend beyond the expiration date of Pat. No. 5,553,783.

[21] Appl. No.: 525,301

[22] Filed: Sep. 8, 1995

[51] Int. Cl.[6] ..... B05B 7/04

[52] U.S. Cl. ..... 239/403; 239/432

[58] Field of Search ..... 239/432, 552, 239/548, 561, 403, 553, 601, 295, 602, DIG. 1

[56] References Cited

U.S. PATENT DOCUMENTS

| | | | |
|---|---|---|---|
| 1,059,611 | 4/1913 | Jordan . | |
| 1,140,655 | 5/1915 | Bell . | |
| 1,450,881 | 4/1923 | Allen . | |
| 1,485,495 | 3/1924 | Eldred et al. . | |
| 2,252,320 | 8/1941 | Hughey | 158/27.4 |
| 2,746,792 | 5/1956 | Hough | 299/18 |
| 3,306,540 | 2/1967 | Reichert | 239/142 |
| 3,519,259 | 7/1970 | Death et al. | 266/34 |
| 3,606,154 | 9/1971 | Tufts | 239/8 |
| 3,741,482 | 6/1973 | Eliason et al. | 239/296 |
| 3,784,111 | 1/1974 | Piggott | 239/427.3 |
| 3,913,845 | 10/1975 | Tsuji | 239/556 |
| 4,014,470 | 3/1977 | Burnham | 239/472 |
| 4,284,239 | 8/1981 | Ikeuchi | 239/8 |
| 4,330,086 | 5/1982 | Nysted | 239/8 |
| 4,343,434 | 8/1982 | Haruch | 239/390 |
| 4,456,181 | 6/1984 | Burnham | 239/403 |
| 4,592,510 | 6/1986 | Grothe | 239/432 |
| 4,765,540 | 8/1988 | Yie | 239/8 |
| 4,972,995 | 11/1990 | Schara et al. | 239/428 |
| 4,989,788 | 2/1991 | Bendig et al. | 239/429 |
| 5,014,790 | 5/1991 | Papavergos | 169/44 |
| 5,176,325 | 1/1993 | Vidusek | 239/419.3 |
| 5,240,183 | 8/1993 | Bedaw et al. | 239/403 |
| 5,289,976 | 3/1994 | Dou et al. | 239/431 |

FOREIGN PATENT DOCUMENTS

| | | | |
|---|---|---|---|
| 62-186112 | 8/1987 | Japan | F23D 11/38 |

*Primary Examiner*—Kevin Weldon

*Attorney, Agent, or Firm*—McCormick, Paulding & Huber

[57] ABSTRACT

A nozzle for atomizing a liquid with a gas, such as an oil/steam or air/water mixture, injects the mixture through a plurality of orifices circumferentially spaced about the longitudinal axis of the nozzle, wherein each orifice defines an axis directed toward a respective portion of a linear target for creating a flat fan spray of substantially uniform fluid distribution. A mixing vane is mounted upstream of the orifices within the nozzle for creating a swirling or vortical flow within a mixing chamber to thoroughly mix the fluids prior to passage through the orifices. The mixing vane is in the form of a pair of transversely-extending, approximately sinusoidal vanes for creating the vortical flow and defining a central aperture for creating an axial flow within the vortical flow. The two-phase mixture is supplied to the mixing vane in a common inlet conduit.

32 Claims, 5 Drawing Sheets

FLAT FAN SPRAY NOZZLE

FIELD OF THE INVENTION

This invention relates to atomizing spray nozzles, and more particularly, to nozzles having spray heads which produce flat fan spray patterns of uniform liquid distribution.

BACKGROUND OF THE INVENTION

Many liquid or gas/liquid spraying devices utilize a nozzle having a spray head which produces a flat fan spray pattern. The most common method to produce such a spray pattern is to dispose an elliptical or rectangular orifice at the tip or discharge end of the spray head, as disclosed in U.S. Pat. No. 5,240,183 ('183 Patent). The drawback of this method is that the spray pattern does not produce a uniform distribution of liquid, especially for two-fluid or gas/liquid spraying devices.

A flat fan spray pattern has also been produced by spray heads having a plurality of circular orifices linearly spaced apart thereon, as disclosed in U.S. Pat. No. 1,485,495 ('495 Patent) and the '183 Patent. The spray head disclosed in the '495 Patent is of rectangular form, while the spray head disclosed in the '183 Patent is cylindrical. To produce the flat fan pattern, each of the orifices is disposed along a given plane and angled outwardly at various angles from the centerline or longitudinal axis of the spray head. It has been found that spray heads such as these tend to produce a non-uniform pattern having areas of high spray density separated by areas of low spray density. Moreover, for a spray head having orifices of a predetermined number and diameter, the greater the angle of the spray emitted from each orifice, as measured from the centerline or spray axis of the spray head, the greater will be the tendency to produce non-uniform spray patterns.

Another drawback of the above-described spray heads for a given orifice diameter, is that the number of spaced linearly aligned orifices disposed on the spray head is limited by the diameter or width of the spray head which, in turn, limits the flow rate of such spray heads which is proportional to the total cross-sectional area of the orifices. In addition, the limited number of orifices would necessitate a greater angle between adjacent orifices for a given spray width thereby producing a non-uniform spray pattern.

A further drawback of the spray head disclosed in the '183 Patent, is that the orifices are disposed at various distances from the longitudinal axis of the mixing chamber. It has been found that in many two-phase systems, such as gas/liquid mixing nozzles, the greatest uniformity of the intermixing of the two phases occurs generally adjacent to the periphery of the mixing chamber. Accordingly, the linearly spaced individual orifices described above do not provide an overall uniform spray pattern.

SUMMARY OF THE INVENTION

Accordingly, it is an object of the present invention to provide a spray head for producing a flat fan spray pattern which overcomes the drawbacks of the prior art.

It is another object to provide a spray head that provides for an arrangement of orifices which results in flat fan spray patterns of greater flow rates and uniformity of the spray pattern.

It is a further object to provide a spray head that substantially equalizes the mass flow ratios of the gas/liquid mixture between the individual orifices and thereby reduces the flow segregation.

According to the present invention, a nozzle for mixing and atomizing a two-phase mixture, such as crude oil and steam for catalytic cracking processes, comprises an inlet conduit for receiving the liquid and gas. A vane assembly of the nozzle extends transversely relative to an elongated axis of the inlet conduit for receiving fluid from the inlet conduit and creating a swirling annular flow, and defines a central aperture for creating a substantially axial flow within the annular flow. A mixing chamber is coupled in fluid communication with the vane assembly for mixing the annular and axial flows and thereby further commingling and atomizing the liquid/gas mixture. An end wall of the nozzle defines a plurality of orifices in fluid communication with the mixing chamber and angularly spaced relative to each other about an axis of the chamber. Each orifice defines a flow axis directed toward a substantially linear target for atomizing and directing a respective portion of the liquid/gas mixture toward the target in a substantially flat fan spray pattern.

Preferably, the orifices are located adjacent to a wall defining the mixing chamber to receive the peripheral flow in the mixing chamber where the intermixing of the gas and liquid is both maximized and substantially equalized throughout, thus creating a substantially uniform fluid distribution.

The above and other objects and advantages of this invention will become more readily apparent when the following description is read in conjunction with the accompanying drawings.

DETAILED DESCRIPTION OF THE PREFERRED EMBODIMENTS

Figure 1:
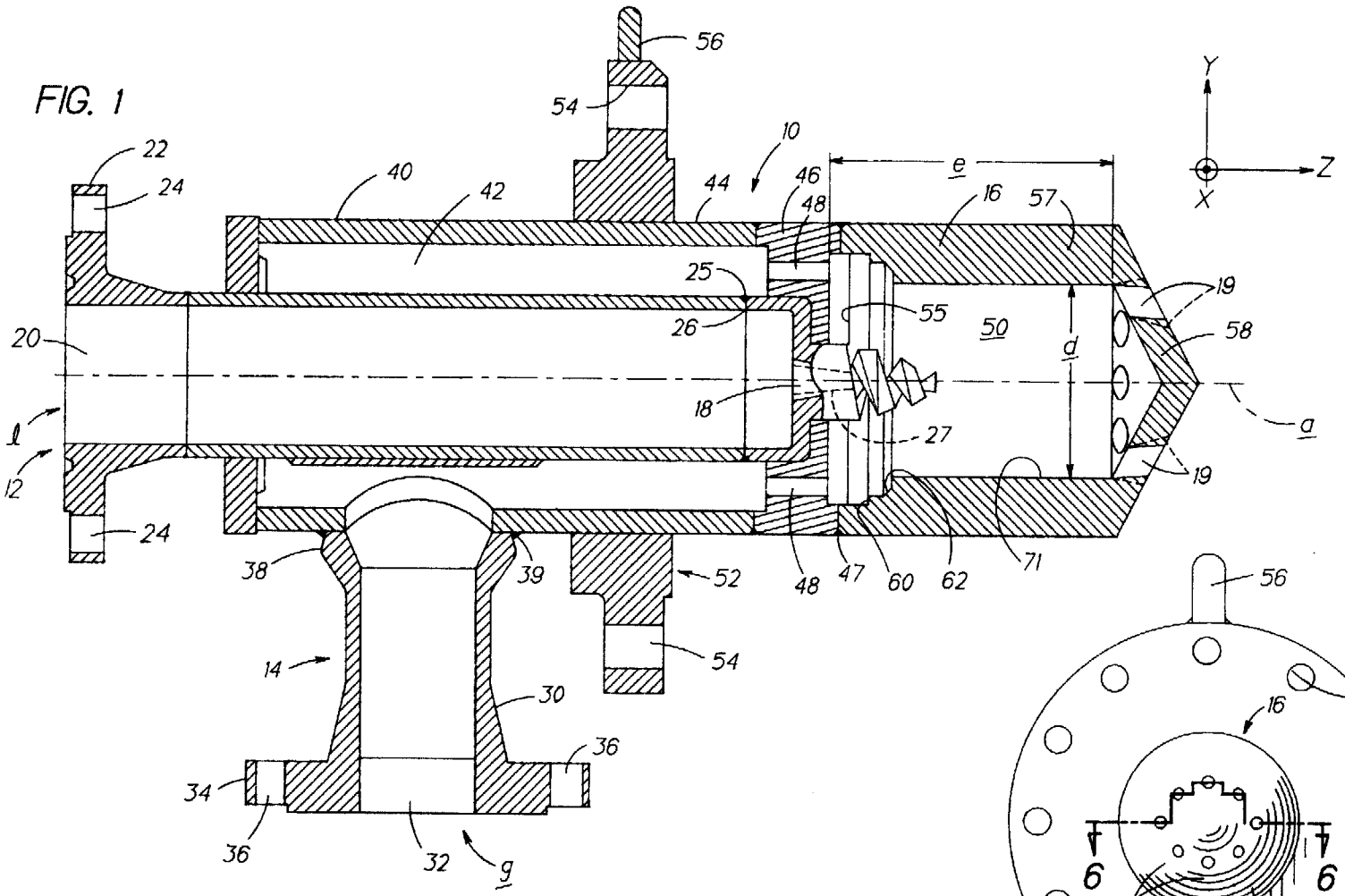
FIG. 1 is a cross-sectional view of a spray nozzle of the type shown in U.S. Pat. No. 5,553,783, also owned by the Assignee of the present invention.
Figure 2:
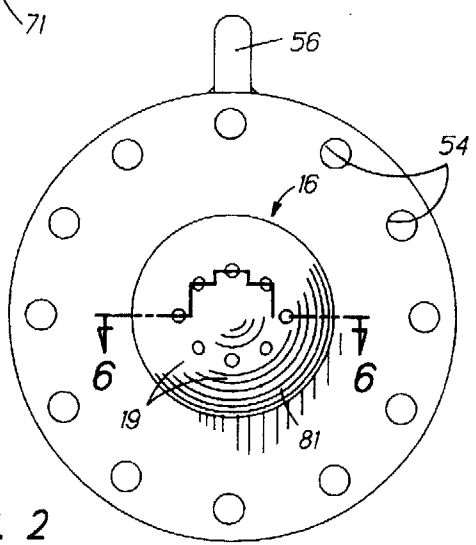
FIG. 2 is a front view of the spray nozzle of FIG. 1.

Depicted in FIG. 1 is a gas/liquid mixing nozzle 10 which is similar to the one disclosed in U.S. Pat. No. 5,240,183 to Bedaw, et al. and assigned to BETE FOG NOZZLE, INC., having a generally cylindrical shaped body and comprising a liquid input conduit 12, a gas input conduit 14, a helical vane or spray member 18, and a spray head 16 co-axially disposed about the helical spray member that controls the spray pattern of the liquid emitted therefrom. As best shown in FIG. 2, a plurality of orifices 19 are disposed in a generally circular pattern about the centerline or longitudinal axis a of the spray head 16. Referring to FIG. 6, each orifice 19 is individually oriented at a predetermined angle so that together the orifices project a flat fan spray pattern along a target 17 at a predetermined distance f from the spray head 16, shown in FIGS. 3 to 5.

The liquid input conduit 12 (FIG. 1) of the nozzle 10 has a longitudinal bore 20 and its outer end 22 is flanged with circumferentially-spaced through bolt holes 24 adapted to be secured to the outer end of a similarly flanged pipe (not shown) for supplying liquid l into the bore 20 under a pressure in the range of approximately 3 to 300 psi. The helical member 18 is secured such as by a weld 25 to the inner end 26 of the liquid input conduit 12 to provide for leak-proof liquid flow from the bore 20 into the tapered bore 27 of the helical member 18.

As shown, the gas input conduit 14 comprises an inlet member 30 having an internal bore 32 and a flanged outer end 34 with bore holes 36 circumferentially disposed thereabout. The inner end 38 of the inlet member is perpendicularly secured by a weld 39 to a tubular member 40 of larger inner diameter disposed concentrically about the liquid input conduit 12 to provide an annular passage 42 into which a gas g, such as compressed air, steam or the like, may be supplied under pressure in the range of approximately 3 to 300 psi by any suitable means. The forward or outlet end 44 of the tubular member 40 is secured, as by welding, to a coupling or fitting 46 adapted to fit about the helical member 18. As shown in FIG. 1, fitting 46 has a plurality of circumferentially-spaced passages 48 which are adapted to receive the pressurized gas flowing through the annular chamber 42 of the tubular member 40 and which direct the high velocity gas into a mixing chamber 50 of the spray head 16. It will be recognized that the compressed gas, rather than being fed through a plurality of circumferentially-spaced ports or bores, could be fed through a unitary or plurality of annular slots (not shown) into the spray head 16. The spray head 16 may be secured to the forward end of the fitting 46 by a weld 47.

An annular mounting flange 52 is disposed about the tubular member 40, and defines a plurality of circumferentially-disposed holes 54 used to mount the nozzle assembly 10. A sighting device or tab 56 (FIGS. 1 and 2) is disposed upon the outer edge of the mounting member 52 to assist with the alignment of the nozzle.

The spray head 16 of generally cylindrical construction provides the chamber 50 for intermixing the liquid and gas phases about the helical member 18. The mixing chamber may be defined by an open inner end 55, a generally cylindrical medial portion 57 and a conically-tapered or spherically-shaped outer end wall portion 58. As will be recognized by those skilled in the pertinent art, the end wall 58 may equally take any of numerous other desired shapes, such as a flat or convex shape, to, for example, meet the requirements of a particular installation. The spray head 16, at its inner end, includes two (2) annular shoulders 60 and 62 which disrupt the laminar flow of the gas as it enters the chamber 50 from the gas passages 48 whereby the high velocity of gas g becomes turbulent for enhanced mixing with the liquid l in the chamber 50 and the atomization of the liquid phase.

The conical outer end wall 58 is provided with a plurality of orifices 19 arranged in circumferentially spaced relationship (FIG. 2) about the longitudinal axis a of the spray head 16. Each of the orifices 19 extends through the outer end wall 58 at a point that is preferably adjacent to the inner surface 71 of the medial portion 57 of the mixing chamber 50, as best shown in FIG. 1. It has been found that when the inner ends of the orifices 19 communicate with the outer peripheral portion of the mixing chamber 50, where the intermixing of the liquid and gas phases is at its optimum, the mass flow ratio, defined as the percentage of liquid-to-gas flowing through each orifice, will be equalized to thereby reduce the flow segregation often encountered in two-phase atomizers.

In accordance with this invention, it has been found preferable to employ a greater number of orifices 19 than was heretofore thought feasible and with each of the orifices disposed at a smaller angle with respect to each adjacent orifice than was previously deemed acceptable. Indeed, the desired flow rate of the atomized liquid is proportional to the total cross-sectional area of the orifices. In the past, however, geometrical constraints limited the choices available because of the preferred linear orientation of the orifices, limited in number by the inner diameter d of the spray head 16. One consideration in the determination of the cross-sectional areas or diameters of the orifices 19 is the required exit velocity of the gas/liquid mixture from the spray head 16 which is inversely proportional to the area of the orifices. A practical consideration is that the cross-sectional areas or diameters of the orifices must be sufficient in cross-section to ensure free passage of the liquid and any particulate matter disposed in the liquid to avoid a problem of the orifices being clogged by the particulate matter. Typically, the number of orifices 19 disposed in the outer wall 58 will range between approximately four (4) to twelve (12).

Figure 5:
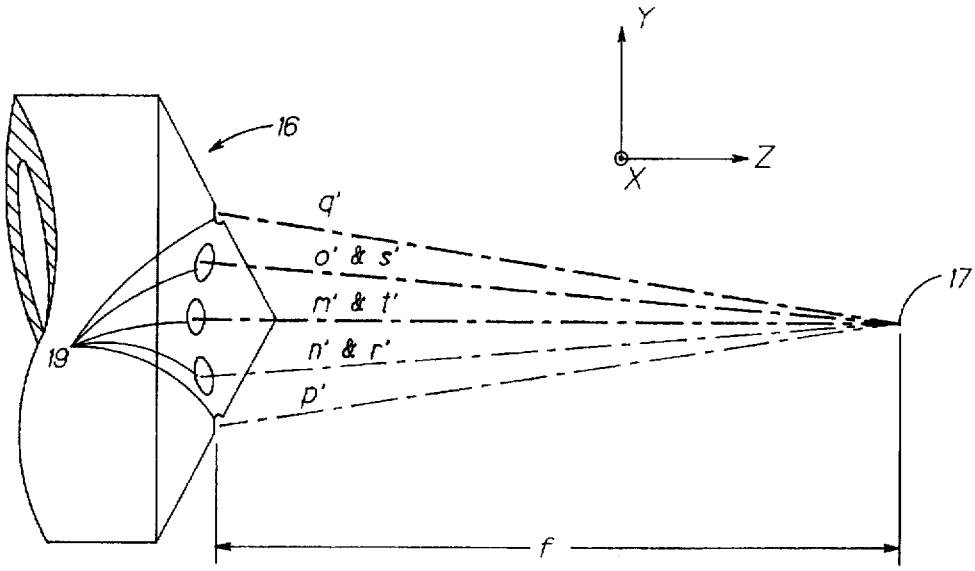
FIG. 5 is a schematic view in the vertical plane (Y-Z) of the nozzle of FIG. 1, which illustrates the trajectory of a spray jet projecting from each orifice onto a target.
Figure 6:
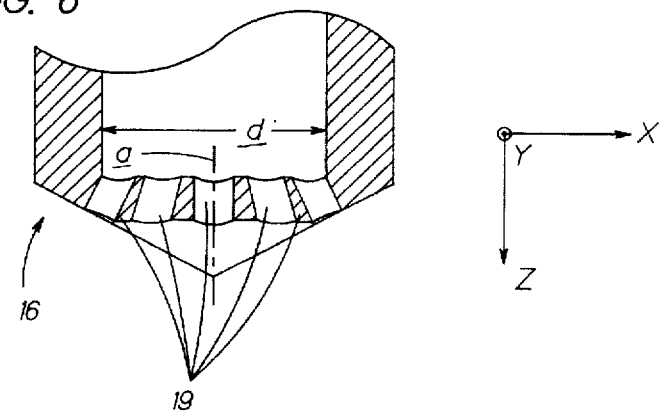
FIG. 6 is a partial cross-sectional view in the horizontal plane (X-Z) of the nozzle taken along line 6—6 of FIG. 2.
Figure 7:
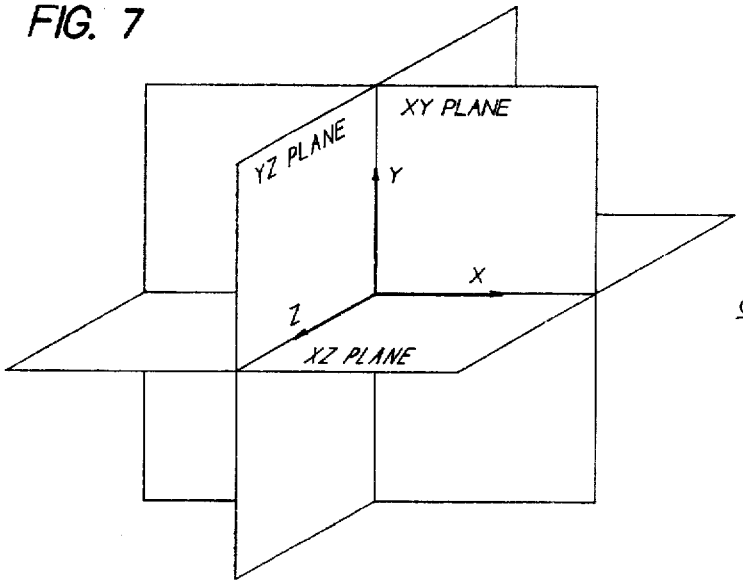
FIG. 7 is a perspective view of three (3) mutually perpendicular planes defined by X, Y and Z axes.

Accompanying FIGS. 1–6 is a spatial reference or coordinate diagram of three (3) mutually perpendicular axes X, Y and Z defining three-dimensional space to assist with the understanding of the interrelation of FIGS. 1–6. Referring to FIG. 7, three (3) mutually perpendicular planes are defined by the X, Y and Z axes such that the X-Y plane (or frontal plane) is defined by the X and Y axes, the X-Z plane (or horizontal plane) is defined by the X and Z axes, and the Y-Z plane (or vertical plane) is defined by the Y and Z axes.

Figure 3:
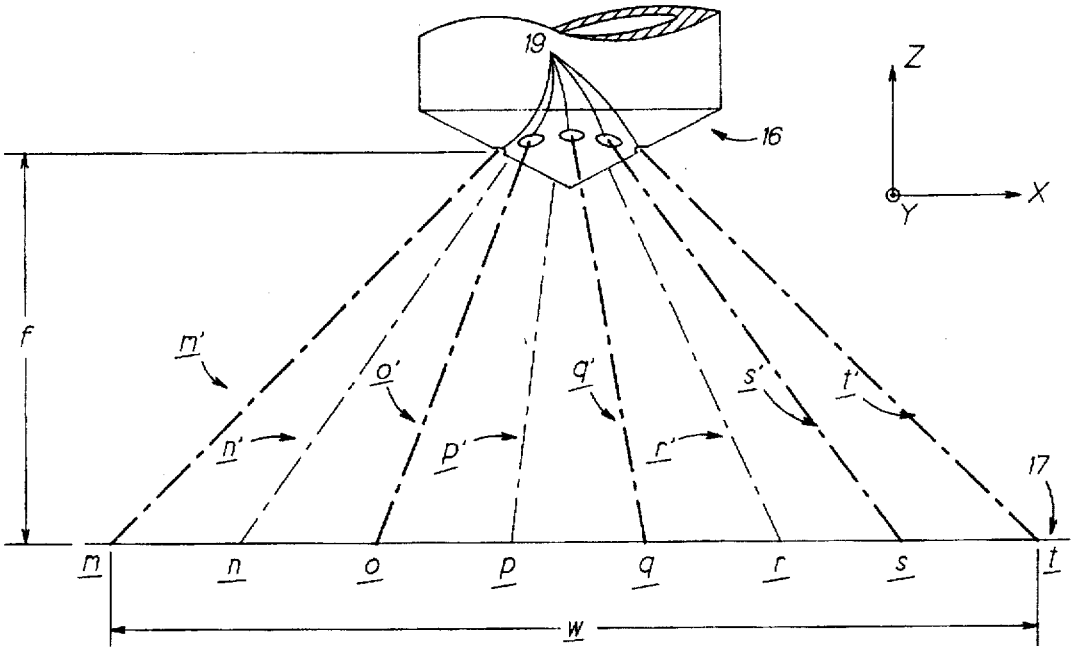
FIG. 3 is a schematic view in the horizontal plane (X-Z) of the nozzle of FIG. 1, which illustrates the trajectory of a spray jet projecting from each orifice onto a target.
Figure 4:
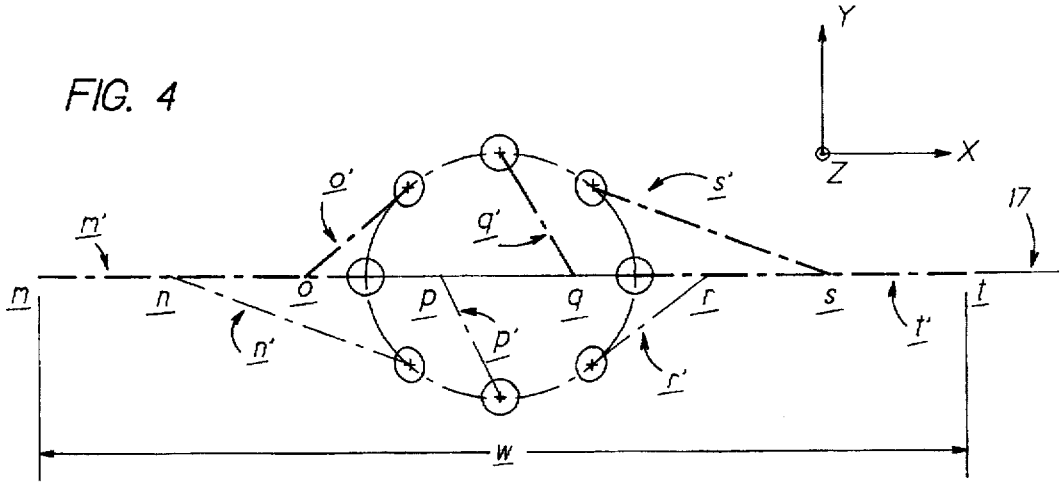
FIG. 4 is a schematic view in the frontal plane (X-Y) of the nozzle of FIG. 1, which illustrates the trajectory of a spray jet projecting from each orifice onto a target.

In the nozzle illustrated in FIGS. 3 to 5, the spray head 16 has eight (8) orifices 19 and the target 17 is parallel to the horizontal plane (X-Z) and generally perpendicular to and centered about the longitudinal axis a of the spray head. Each orifice 19 is individually angled such that the spray emanating from the spray head is projected as a flat spray along a line or target 17 at a predetermined distance f (FIGS. 3 and 5). It should be recognized that the target may be disposed at varying orientations in space by simply modifying the angles of the orifices.

FIGS. 3 to 5 diagrammatically show the trajectory of the spray jets or projections (m to t) emanating from each corresponding orifice of the spray head. The spray jets are represented by a centerline or dotted line that corresponds with the longitudinal axis of each orifice. As best shown in FIG. 4, the spray jets (n, p and r), which project from the orifices below the target, are represented by a dotted line. Note that the trajectory of the spray jets do not take in consideration the effect of gravity.

FIG. 3 shows in the horizontal X-Z plane, the trajectory of the spray jets (m to t) emanating from each corresponding orifice 19 to a corresponding point (m to t) on the target 17.

The orifices 19 are angled radially outward from the longitudinal axis a of the cylindrical spray head 16 in the horizontal plane (FIG. 6) to produce a fan pattern of predetermined width w (FIGS. 3 and 4) along the target 17. The angles of the orifices in the horizontal plane (FIG. 6) outwardly increase as the orifices are disposed further from the longitudinal axis a of the spray head 16 to prevent the trajectories of the spray jets from crossing or intersecting each other. The orifices 19 are preferably angled such that the spray jet from each orifice is equi-spaced along the target 17, as shown in FIG. 3, so as to produce a spray pattern of uniform and evenly distributed material along the target. It should be recognized that the orifices 19 may be angled so that the spray jets intersect the target at varying spacing to provide a spray pattern more concentrated in predetermined areas along the target than others.

To form the flat fan pattern, the orifices 19 (FIG. 1) must also be individually angled in the vertical plane Y-Z such that the spray jets (m to t) converge upon the target 17, as illustrated in FIG. 5. The angle of convergence of each orifice is dependent upon the distance f of the target from the spray head and the disposition of the orifice on the spray head. In the preferred embodiment, as depicted in FIG. 5, spray jets m and t project in the same horizontal plane (X-Z) as the target. The angle of the trajectory of spray jets o and s, in the vertical plane (Y-Z), are equal, but opposite to the angle of spray jets n and r. The angle of the trajectory of spray jets p and q, in the vertical plane Y-Z are equal, but opposite to each other, and greater than the angle of spray jets o, s, n, and r.

A schematic view of the spray head in the frontal plane X-Y is shown in FIG. 4 which simultaneously illustrates both the angle of divergence and angle of convergence of each spray jet (m to t), shown in FIGS. 3 and 5 respectively. Each orifice 19 is preferably angled such that the jets of the orifices disposed above the target (jets o, q, and s) and the jets of the orifices disposed below the target (jets n, p, and r) alternately project along the target to provide for symmetry about the longitudinal axis a of the spray head 16.

Figure 8:
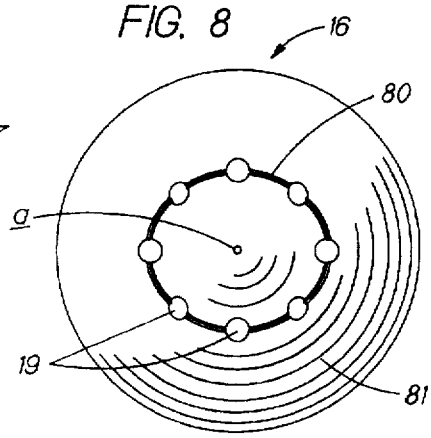
FIG. 8 is a front elevational view of an alternative embodiment of a nozzle of the type shown in U.S. Pat. No. 5,553,783 and having a V-shaped groove interconnecting the orifices.

In the nozzle illustrated in FIG. 8, the orifices 19 are interconnected by a U-shaped or V-shaped groove or channel 80 that is inscribed on an outer surface 81 of the spray head 16. The width of the channel is preferably between approximately 0.3 and 0.6 times the width or diameter of the orifice and the depth thereof may be between approximately 0.15 and 0.5 times the width or diameter of the orifice. The angle of the walls of the V-shaped channel 80 is preferably between approximately 60° and 90°. The channel is centered about the longitudinal axis of each orifice 19 and opens generally parallel to the longitudinal axis a of the spray head 16.

The channel 80 widens the outer edge of the orifices 19 such that the spray jets (m to t), as shown in FIG. 3, emanating therefrom peripherally expand along the channel upon exiting each orifice to thereby produce a broader orifice jet pattern being less concentrated than one emanating from an orifice. The expanded spray jet spans a greater area along the target 17 to produce a more uniform spray distribution.

It will be recognized by those skilled in the art that one or more of the orifices, illustrated as being circular in the drawings, could be changed to include various non-circular cross-sections, such as elliptical, rectangular, or square. Similarly, it may be desirable to form each orifice so that it flares outwardly toward its downstream end, as indicated in broken lines in FIG. 1, to reduce the exit velocity of the liquid/gas mixture without reducing or significantly affecting the pressure within the mixing chamber 50.

For proper operation of the nozzle 10, it is important that the inner diameter d, as shown in FIG. 1, of the cylindrical portion 57 of the spray head 16 be substantially greater than the maximum outer diameter of the helical member 18. It has also been found that the ratio of the length e of the spray head, as shown in FIG. 1, to the inner diameter d of the spray head should be approximately 1.5 to 1.7.

As liquid l under pressure is fed through the longitudinal bore 20 of the tube 12 and flows into the tapered bore 27 of the helical element 18, the liquid is deflected outwardly by the upstream surfaces of the helical member into a thin conical sheet. Simultaneously, compressed gas g being supplied into annular passage 42 and which flows though bores 48, will enter the mixing chamber 50 at high velocity and in a turbulent state, and impact with the liquid.

In the mixing chamber 50, the turbulent and high velocity expanding gas g emanating from the holes 48 intersects the thin conical sheet of liquid l emitted from the surfaces of the helical member 18. This action causes the liquid to be atomized by and mixed with the expanding gas. As the liquid/gas mixture is impelled through the chamber 50, further mixing and atomization occurs as it advances toward the orifices 19. The pressurized gas/liquid mixture rapidly expands as it exits the orifices 19 to ambient or atmospheric pressure to cause further atomization of the mixture.

It has been found that this nozzle construction will produce very fine liquid sprays in which the average droplet size may vary, depending on the flow ratio from approximately 10 microns to 500 microns.

Figure 9:
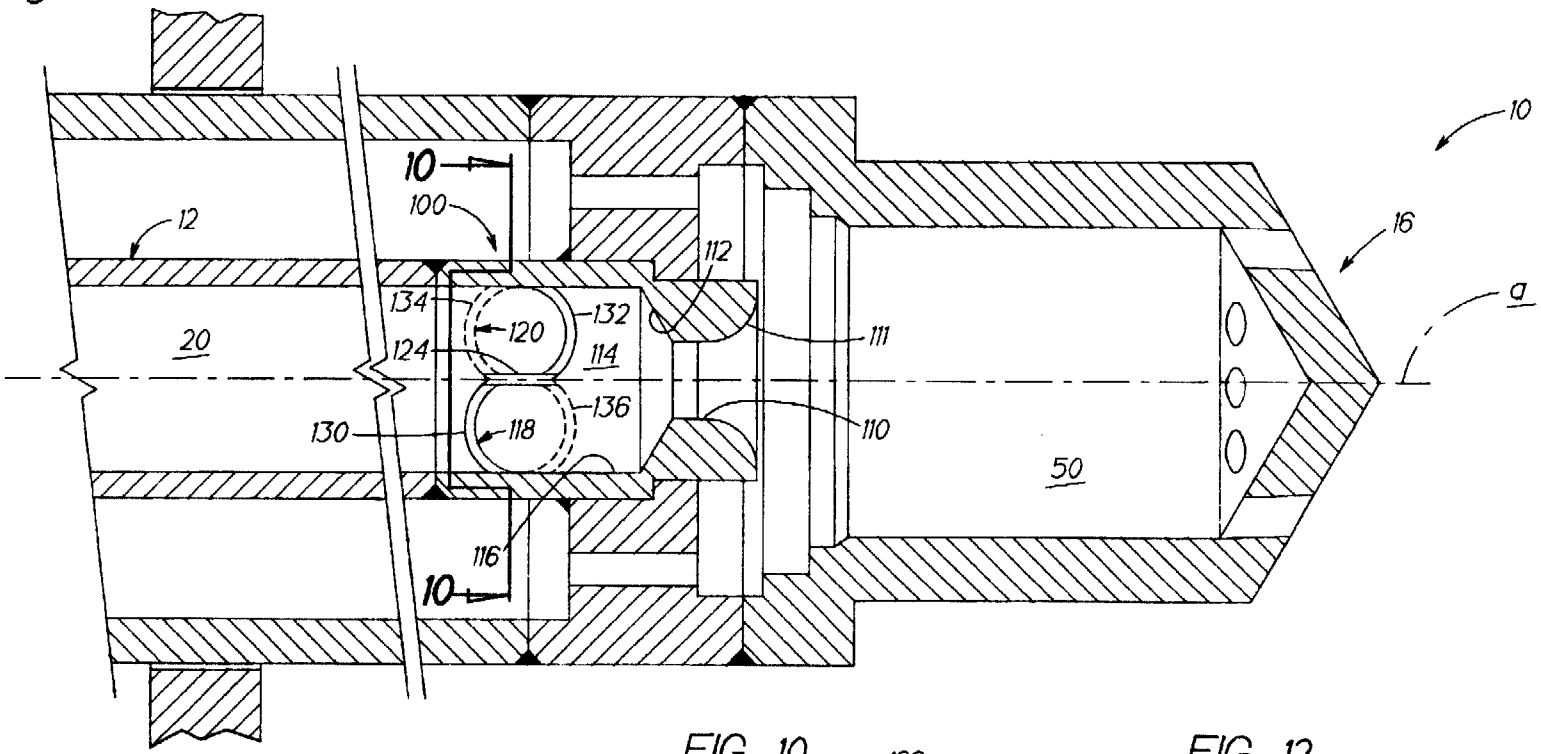
FIG. 9 is a cross-sectional view of an alternative embodiment of a nozzle of the type shown in U.S. Pat. No. 5,553,783.

In the nozzle shown in FIG. 9, an approximately sinusoidal spray member 100 of the type similar to the spray nozzle disclosed in U.S. Pat. No. 4,014,470 to Burnham and assigned to BETE FOG NOZZLE, INC., may be used in lieu of the helical spray member 18. The spray member 100 may be a tubular unitary body similar to the liquid input conduit 12 having an outlet end with a central outlet orifice 110 of cylindrical configuration which extends through the outer end wall 111 thereof and intersects with conical surface 112, which constitutes the outlet wall of an outlet chamber 114. The outer end wall 111 radially flares from the longitudinal axis a of the spray head 16 to expand the liquid spray pattern about the mixing chamber 50 of the spray head 16. The outlet chamber 114 is also defined by the inner diameter or cylindrical bore 116 of the spray member 100.

Swirl imparting means are provided by transversely extending segmental vanes 118 and 120 which separate the outlet chamber 114 from cylindrical bore 20 of the liquid input conduit 12.

Figure 10:
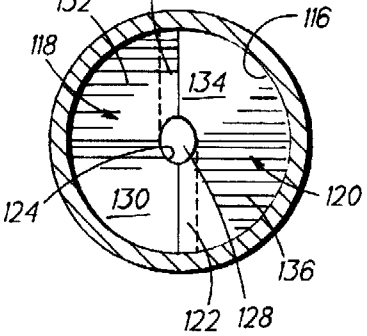
FIG. 10 is a cross-sectional view of the alternative embodiment of FIG. 9 taken along line 10—10.

As shown in FIG. 9, the vanes 118 and 120 each comprise two generally semi-circular segments defining an approximately sinusoidal configuration. It will be noted that the two vanes 118 and 120 are juxtaposed in edge-to-edge relation defining a figure "8" which extends horizontally across the bore 20 of the nozzle 10. As shown at 122 (FIG. 10), the vanes overlap circumferentially to some extent on diametrically opposite sides of the opening 128 to ensure against direct axial flow of the annular portion of the flow pattern. Each vane 118 and 120 has an identical arcuate recess 124 (FIG. 9), provided along its inner edge, by which the generally elliptical central opening 128 is formed.

viewed in the direction of fluid flow (FIG. 9), semicircular vane 118 has a convex lobe 130, in one quadrant of the passage facing upstream and a concave lobe 132 in the adjacent quadrant. Similarly, as shown in broken lines, vane 120 has a convex lobe 134 in a quadrant of the passage diametrically opposite convex lobe 130 of the vane 118 and a concave lobe 136 in a quadrant diametrically opposite concave lobe 132 of the vane 118. The vanes are thus approximately sinusoidal and, as best shown in FIG. 9, the cylindrically curved lobe portions of each of the vanes 118 and 120 are interconnected by axially-extending leg portions which cross at about the center of the bore 20 and are recessed as at 124 to form the central flow opening 128.

A liquid or liquid slurry under pressure, such as water-borne particulates, may be supplied to the spray member 100 via the liquid input conduit 12 of the nozzle 10. The slurry moves within the confines of the bore 20 as a column or single stream until contacting the vanes 118 and 120 where the liquid column is separated into two (2) streams or portions. One stream is annular, the other axial. A swirling movement is imparted to the outer peripheral or annular stream of the slurry as it passes over the surface of the vanes 118 and 120, while the central portion of the slurry passes more or less directly through the central opening 128 formed by the vanes. In the outlet chamber 114, the vortical stream caused by the vanes 118 and 120 and the axially moving stream reunite and mix together, thereby providing for uniform particulate dispersion in the liquid phase in the mixing chamber 50 of the spray head 16. In addition, this mixing is enhanced by the dimensional relationship of the central outlet orifice 110 to the much larger cross-sectional diameter of the outlet chamber 114 and conical upper surface 112.

Figure 11:
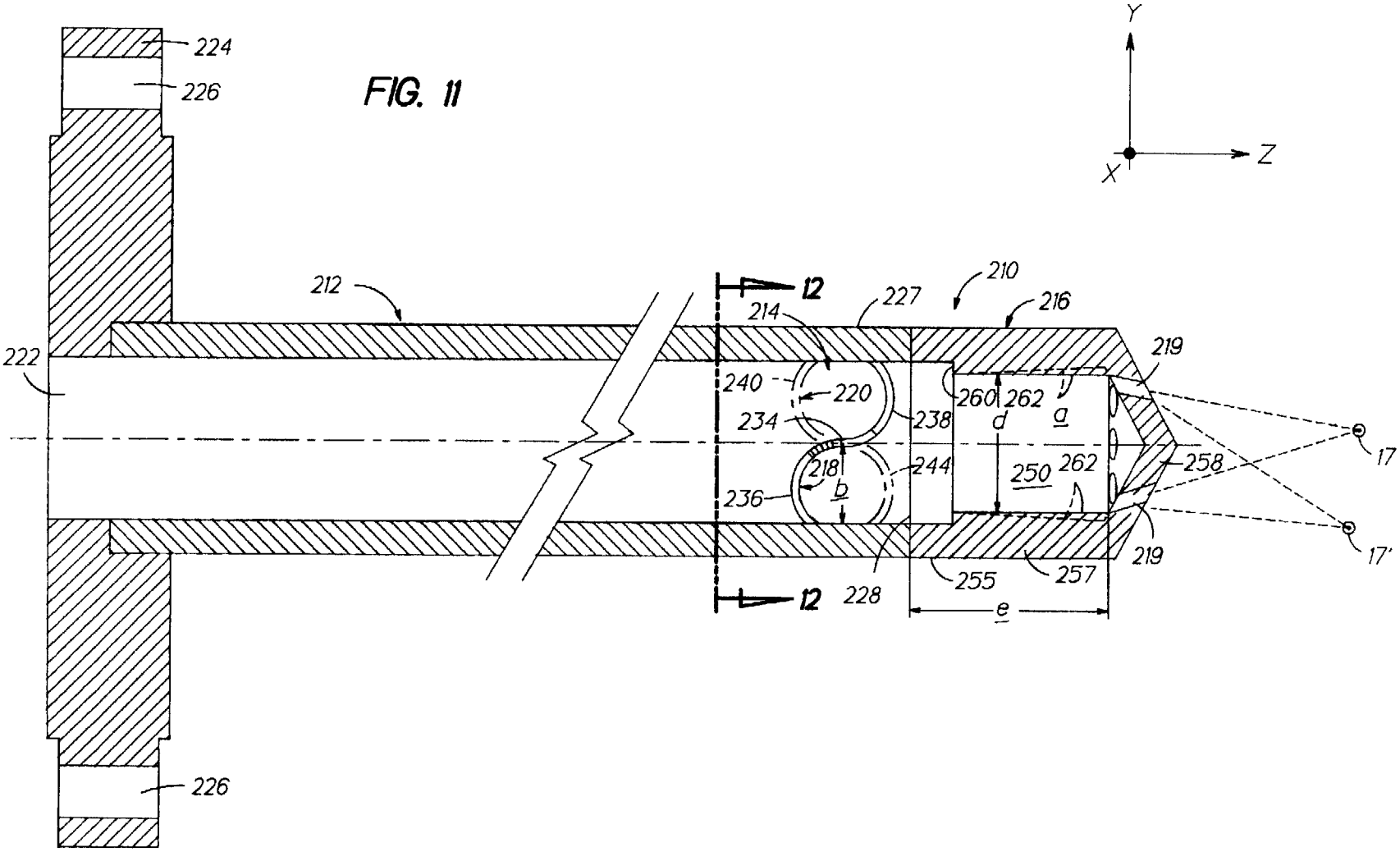
FIG. 11 is a cross-sectional view of a nozzle embodying the present invention having a common inlet conduit for two-phase mixtures.

Turning to FIG. 11, a two-phase spray nozzle for mixing liquid and gas, such as crude oil and superheated steam for use in catalytic cracking processes, is indicated generally by the reference numeral 210. The spray nozzle 210 is the same in many respects as the spray nozzle 10 described above with reference to FIGS. 9 and 10, and therefore like reference numerals preceded by the numeral 2 are used to indicate like elements.

The spray nozzle 210 comprises a two-phase or common input conduit 212 for receiving a liquid/gas mixture, a swirl imparting means mounted in the downstream end of the input conduit, and a spray head 216 for controlling the spray pattern of the liquid/gas mixture emitted therefrom. As with the embodiment of the spray nozzle 10 described above with reference to FIGS. 9 and 10, the swirl imparting means comprises transversely extending segmental vanes 218 and 220 which separate the spray head 216 from the input conduit 212. Also like the embodiments described above, a plurality of orifices 219 are disposed in a generally circular pattern about the centerline or longitudinal axis a of the spray head 216. Each orifice 219 is individually oriented at a predetermined angle so that together the orifices project a flat fan spray pattern along a linear target located a predetermined distance from the spray head. As shown typically in FIG. 11, the upstream end of each orifice 219 is located adjacent to the inner surface 262 of the spray head so that the orifices communicate with the outer peripheral portion of the mixing chamber, wherein the intermixing of the gas and liquid is both maximized and substantially equalized throughout.

As with the embodiments described above, the spray head 216 defines (8) orifices 219, and the target is both parallel to the horizontal (X-Z) plane and generally perpendicular to and centered about the spray head's longitudinal axis a. In the same manner as described above, each orifice 219 is individually angled such that the spray emanating from the spray head is projected as a substantially flat fan spray of a predetermined width extending along, and converging upon a line or target 17 at a predetermined distance from the end of the nozzle. Accordingly, like the embodiments described above, the circumferentially-spaced orifices 219 define a generally circular pattern on their upstream ends and a generally elliptical pattern on their downstream ends. As also described above, the orifices 219 are preferably angled relative to each other so that the spray jet from each orifice is equi-spaced along the linear target to produce a spray pattern of uniform and evenly distributed material; however, the orifices may likewise be angled so that the spray jets intersect the target at varying spacing to provide a spray pattern more concentrated in predetermined areas along the target than others.

As will be recognized by those skilled in the pertinent art, the target 17 may be disposed at varying orientations in space by modifying the angles of the orifices. For example, it may be desirable to space the target away from the longitudinal axis a of the nozzle, as shown, for example, at 17' in FIG. 11 depending upon the requirements of a particular system or in order to operate a system more efficiently. For example, in a catalytic cracking process, it may be desirable to adjust the angle of the flat fan spray pattern with respect to the axis of the nozzle or with respect to the axis of the cracking tower, as shown for example at 17' in FIG. 11, in order to reduce the amount of catalyst that must be penetrated to obtain full coverage of the oil/steam mixture.

As shown in FIG. 11, the input conduit 212 of the nozzle 210 has a longitudinal bore 222 and its outer end 224 is flanged with circumferentially-spaced through bolt holes 226 adapted to be secured to the outer end of a similarly flanged pipe (not shown) for supplying a liquid/gas mixture, such as crude oil and steam, into the bore 222 under a pressure in the range of approximately 3 to 300 psi. The vanes 218 and 220 are secured within the inner end 227 of the input conduit 212, and the spray head 216 is secured to the end face of the input conduit by welding or other suitable means.

Figure 12:
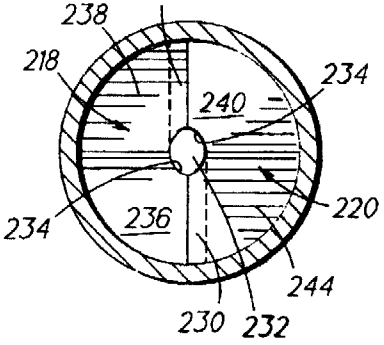
FIG. 12 is a cross-sectional view of the nozzle of FIG. 11 taken along line 12—12.

As shown in FIG. 12, in the same manner as the swirl imparting means described above, the vanes 218 and 220 each define two approximately semi-circular segments (236, 238 and 240,244), and thus each vane defines an approximately sinusoidal configuration for creating a swirling or vortical outer peripheral or annular flow. Each vane also defines an axially and transversely-extending leg portion forming an arcuate recess 234 along its inner edge, which in turn defines a central opening 232 through the vanes for axial flow.

As also shown in FIG. 11, the spray head 216 of generally cylindrical construction defines a mixing chamber 250 for further intermixing of the two-phase mixture, such as crude oil and steam. The chamber 250 may be defined by an open inner end 255, a generally cylindrical medial portion 257, and an end wall portion 258. As described above, although the end wall 258 illustrated is conical shaped, it may equally be formed in a spherical, flat, convex or other desired shape. In addition, as shown in broken lines in FIG. 11, it may also be desirable to form the wall 262 defining the mixing chamber 250 so that it flares outwardly toward the downstream end of the nozzle defining an approximately frusto-conical shape in order to increase the overall cross-sectional area of the end wall portion 258 and thereby permit an increase in the number of orifices 219 and/or an increase in their effective cross-sectional areas.

The spray head 216 includes at its inner end an annular shoulder 260 which breaks up the liquid boundary layer and disrupts the vortical flow of the gas/liquid mixture as it enters the chamber 250, whereby the high velocity mixture becomes turbulent for enhanced mixing of the gas and liquid in the chamber and the atomization of the liquid. For optimum performance of the nozzle 210, it has been found that the ratio of the distance e, defined as the distance between the downstream end of the sinusoidal vanes 218 and 220 and the downstream end of the cylindrical wall 262 of the mixing chamber, to the inner diameter d of the spray head, should be less than approximately 2, and preferably within the range of approximately 1.5 to 2.0.

In the operation of the nozzle 210, a two-phase mixture, such as a liquid/gas mixture of crude oil and superheated steam, is premixed by, for example, a diffuser or by simply injecting the steam into the oil before entering the input conduit 212 of the nozzle. As the oil/steam mixture moves under pressure within the confines of the bore 222, the oil and steam begin to separate prior to reaching the vanes 218 and 220. Then, as the fluid flows across and through the vanes 218 and 220, the stream is separated into two streams, an outer peripheral or annular stream and an axial stream. A swirling movement is imparted to the outer peripheral or annular stream of the oil/steam mixture as it passes over the surface of the vanes 218 and 220, while the central portion of the mixture passes more or less directly through the central opening 232 formed by the vanes. The separating of the single stream by the swirl imparting means allows the crude oil or other liquid of high viscosity to be more thoroughly mixed.

Specifically, and with reference to FIG. 11, the oil/steam mixture from the input conduit 212 flows into the diametrically-opposed convex upstream lobes 236 and 240 of the vanes 218 and 220, whereupon the outer portion of the fluid stream flows across the convex lobes and in turn across the adjacent downstream concave lobes 238 and 244. From the concave lobes, the oil/steam mixture flows transversely through the openings b formed between the vanes, and in turn impinges to some extent against the downstream or orifice-facing sides of the vanes. The axially and transversely-oriented leg portions of the vanes impart an axial component of motion to the fluid flow issuing through the vane openings b. The rotary and axial components of motion thus imparted to the annular stream of the oil/steam mixture results in the mixture having a vortical or whirling motion as it moves into the mixing chamber 250.

In addition to the vortical motion imparted by the vanes 218 and 220, part of the inlet oil/steam mixture passes directly through the generally elliptical central opening 232. Due to the fact that there is some overlap 230 in the diametrically opposed outer ends of the two vanes 218 and 220, the axial flow is wholly confined to this central portion.

As the axial and vortical streams exit the vanes 218 and 220, the two streams reunite within the mixing chamber 250. The vortical stream is disrupted by the annular shoulder 260, which breaks up the liquid boundary layer and re-entrains and/or further mixes and atomizes the two-phase mixture as it enters the mixing chamber. The oil/steam mixture is then impelled through the mixing chamber 250 and is further atomized as it advances toward the orifices 219. The pressurized oil/steam mixture rapidly expands as it exits the orifices 219 to ambient or atmospheric pressure to cause additional atomization of the mixture and form a flat fan spray pattern along the target.

In addition to the advantages described above, one advantage of the nozzles of FIGS. 9 to 12 is that they are particularly useful for atomizing relatively heavy or viscous fluids, such as heavy grade crude oil for producing a flat fan spray of sufficiently small size droplets for catalytic cracking or like processes requiring such atomization. The nozzle of FIGS. 11 and 12 is particularly advantageous because it is less complicated and has fewer parts, and is therefore typically less expensive to manufacture.

As will be recognized by those skilled in the pertinent art, the nozzles of the present invention may be used for atomizing fluids, including multi-phase fluid mixtures, for many different processes. As described above, the nozzles of the present invention provide a flat fan spray pattern of substantially uniform liquid distribution across a linear target, and are therefore particularly effective for atomizing oil/steam mixtures in catalytic cracking processes. Similarly, the nozzles of the present invention may be used for applying fluid coatings where, for example, it is necessary to apply a substantially uniform fluid coating or film to a product. The nozzles of the present invention may likewise be used for applying an air/water or like two-phase mixture in the manufacture of numerous products, such as for strip-cooling steel or other metals, or for moistening webs of paper or felt. As indicated above, in effecting such different processes, it may be necessary to alter the number of orifices, the angular orientation of the orifices, and/or the relative locations of the orifices in order to provide a spray of substantially uniform or other predetermined liquid distribution and to focus such spray onto a flat, linear or other desired target configuration.

Accordingly, although the invention has been shown and described with respect to an exemplary embodiment thereof, it should be understood by those skilled in the art that the foregoing and various other changes, omissions, and additions in the form and detail thereof may be made therein without departing from the spirit and scope of the invention as defined in the claims.

What is claimed is:

1. A nozzle for mixing a liquid with a gas, comprising:

an inlet conduit for receiving the liquid and gas;

at least one vane extending transversely relative to an elongated axis of the inlet conduit for receiving a portion of the liquid and gas from the inlet conduit and creating a swirling annular flow, and defining at least a portion of an aperture in an approximately central portion thereof for receiving a portion of the liquid and gas from the inlet conduit and creating a substantially axial flow;

a mixing chamber coupled in fluid communication with the at least one vane for mixing the annular and axial flows; and an end portion defining a plurality of apertures in fluid communication with the mixing chamber and angularly spaced relative to each other about an axis of the mixing chamber, wherein approximately all of the apertures each define a flow axis directed toward a target for atomizing and directing the liquid-gas mixture in a spray pattern flowing in a direction across the target, and the target is substantially located within a plane extending in the flow direction of the spray pattern.

2. A nozzle as defined in claim 1, wherein the liquid/gas mixture is comprised of oil and steam.

3. A nozzle as defined in claim 1, wherein the mixing chamber is defined by a substantially cylindrical surface extending between the at least one vane and the plurality of apertures, and the ratio of the length of the mixing chamber to its diameter is within the range of approximately 1.5 to 2.0.

4. A nozzle as defined in claim 1, wherein each of the plurality of apertures is spaced adjacent to a surface defining the mixing chamber for receiving peripheral fluid flow from the mixing chamber.

5. A nozzle as defined in claim 1, wherein the apertures are spaced relative to each other along a closed curve.

6. A nozzle as defined in claim 1, wherein the upstream ends of the apertures define a substantially circular pattern.

7. A nozzle as defined in claim 1, wherein the target is linear and approximately intersects the axis of the mixing chamber.

8. A nozzle as defined in claim 1, wherein each aperture is defined by a substantially cylindrical surface within the end portion of the nozzle.

9. A nozzle as defined in claim 1, wherein the apertures are angled relative to each other such that their sprays are substantially equally spaced along the target.

10. A nozzle as defined in claim 1, wherein the apertures are substantially equally spaced relative to each other about a longitudinal axis of the mixing chamber.

11. A nozzle as defined in claim 1, wherein the end portion of the nozzle is substantially conical shaped.

12. A nozzle as defined in claim 1, wherein the at least one vane defines a substantially convex lobe and a substantially concave lobe.

13. A nozzle as defined in claim 12, wherein each lobe is approximately semi-circular.

14. A nozzle as defined in claim 12, wherein the convex lobe is located upstream of the concave lobe.

15. A nozzle as defined in claim 12, comprising two vanes, each vane transversely extending through a respective substantially semi-circular portion of the inlet conduit.

16. A nozzle as defined in claim 1, wherein each aperture is defined by a surface flaring outwardly toward its downstream end.

17. A nozzle as defined in claim 1, wherein the mixing chamber is defined by a surface flaring outwardly toward its downstream end.

18. A nozzle for mixing a liquid with a gas, comprising:

an inlet conduit for introducing the liquid and gas into the nozzle;

means coupled in fluid communication with a downstream end of the inlet conduit for creating a swirling peripheral flow of the liquid and gas;

means coupled in fluid communication with a downstream end of the inlet conduit for creating an axial flow of the liquid and gas within the peripheral flow;

a mixing chamber for receiving and further mixing the liquid and gas in the peripheral and axial flows; and means coupled in fluid communication with the mixing chamber for atomizing and directing a plurality of spray jets of the liquid-gas mixture angularly spaced relative to each other about an axis of the mixing chamber, and for directing approximately all of the plurality of spray jets to converge in a spray pattern toward a target, wherein the spray pattern extends in a flow direction across the target and the target is substantially located within a plane extending in the flow direction of the spray pattern.

19. A nozzle as defined in claim 18, wherein each spray jet is coupled in fluid communication with the mixing chamber adjacent to a surface defining the mixing chamber for receiving peripheral fluid flow from the chamber.

20. A nozzle as defined in claim 18, wherein the means for atomizing and directing a plurality of spray jets includes a plurality of orifices defined within an end portion of the nozzle, wherein the orifices are angularly spaced relative to each other about an axis of the mixing chamber and each orifice defines a flow axis converging toward the target.

21. A nozzle as defined in claim 20, wherein each orifice is defined by a surface flaring outwardly toward its downstream end.

22. A nozzle as defined in claim 18, wherein the spray jets are circumferentially spaced about the axis of the mixing chamber.

23. A nozzle as defined in claim 18, wherein the spray jets are substantially equally spaced along the target.

24. A nozzle as defined in claim 18, wherein the target is linear and approximately intersects the axis of the mixing chamber.

25. A nozzle as defined in claim 18, wherein the spray jets are substantially equally spaced relative to each other about the axis of the mixing chamber.

26. A nozzle as defined in claim 18, wherein the means for creating a swirling peripheral flow includes at least one vane extending transversely relative to an elongated axis of the nozzle, and defining a substantially convex lobe and a substantially concave lobe.

27. A nozzle as defined in claim 26, wherein the means for creating an axial flow includes an aperture formed at least in part by an approximately central portion of the vane.

28. A nozzle as defined in claim 26, comprising two vanes, each vane transversely extending through a respective substantially semi-circular portion of the nozzle.

29. A nozzle as defined in claim 18, wherein the mixing chamber is defined by a surface flaring outwardly towards its downstream end.

30. A nozzle as defined in claim 18, wherein the target is located substantially within a plane oriented at an acute angle relative to an elongated axis of the mixing chamber.

31. A nozzle as defined in claim 18, wherein the liquid is oil, the gas is steam and the nozzle is adapted for use in a catalytic cracking process.

32. A nozzle as defined in claim 31, wherein the target is located substantially within a plane oriented at an acute angle relative to an elongated axis of the mixing chamber and the angle is selected to reduce the amount of catalyst that must be penetrated to obtain full coverage of the oil-steam mixture.

* * * * *